US007179146B2

(12) United States Patent
Johnson

(10) Patent No.: US 7,179,146 B2
(45) Date of Patent: Feb. 20, 2007

(54) SWIMMER TRAINING PADDLE SIMULATING SHAPE OF HUMAN HAND

(75) Inventor: Ronald L. Johnson, Scottsdale, AZ (US)

(73) Assignee: Mentor Aquatics, LLC, Waddell, AZ (US)

( * ) Notice: Subject to any disclaimer, the term of this patent is extended or adjusted under 35 U.S.C. 154(b) by 0 days.

(21) Appl. No.: 10/410,084

(22) Filed: Apr. 9, 2003

(65) Prior Publication Data

US 2004/0203301 A1 Oct. 14, 2004

(51) Int. Cl.
*A63B 31/10* (2006.01)
*A63B 31/12* (2006.01)

(52) U.S. Cl. ..... 441/56; 441/58; 482/55

(58) Field of Classification Search ..... 441/55–59; D21/807, 678; 482/55; 434/254
See application file for complete search history.

(56) References Cited

U.S. PATENT DOCUMENTS

| | | | | | |
|---|---|---|---|---|---|
| 91,300 | A | * | 6/1869 | Barnett | 441/58 |
| 91,800 | A | * | 6/1869 | Barnett | 110/196 |
| 183,045 | A | | 10/1876 | Dunlop | |
| 1,395,914 | A | * | 11/1921 | Grundmann | 441/58 |
| 1,621,693 | A | | 3/1927 | Theobold | |
| 2,010,750 | A | * | 8/1935 | Dawzda | 441/57 |
| 2,017,463 | A | | 10/1935 | Komadina | 9/21 |
| 2,109,429 | A | | 11/1938 | Malm | 9/21 |
| 2,159,972 | A | * | 5/1939 | Larson | 441/58 |
| 2,555,969 | A | * | 6/1951 | Holcombe | 441/58 |
| 3,397,414 | A | * | 8/1968 | Webb | 441/56 |
| 3,765,042 | A | | 10/1973 | Montrella | 9/307 |
| 4,913,418 | A | * | 4/1990 | Schlueter et al. | 482/55 |
| D363,754 | S | * | 10/1995 | Johnson | D21/807 |
| 5,511,998 | A | * | 4/1996 | Johnson | 441/56 |
| 5,516,319 | A | * | 5/1996 | Nessel | 441/56 |
| 5,651,710 | A | * | 7/1997 | Rives et al. | 441/58 |
| 5,658,224 | A | * | 8/1997 | Betrock | 482/55 |
| 6,019,650 | A | * | 2/2000 | Rives et al. | 441/58 |
| D437,912 | S | * | 2/2001 | Chiang | D21/807 |
| 6,183,396 | B1 | * | 2/2001 | Reynier | 482/8 |
| D439,299 | S | * | 3/2001 | Chiang | D21/807 |
| D443,013 | S | * | 5/2001 | Chiang | D21/807 |

FOREIGN PATENT DOCUMENTS

| | | | |
|---|---|---|---|
| EP | 993846 | A1 * | 4/2000 |
| JP | 09192263 | A * | 7/1997 |
| WO | 8908479 | A * | 9/1989 |

* cited by examiner

*Primary Examiner*—Ajay Vasudeva
(74) *Attorney, Agent, or Firm*—Cahill, von Hellens & Glazer, P.L.C.

(57) ABSTRACT

A swimmer's hand paddle simulating a human hand is formed from a generally planar member of PVC foam and has a central dome-shaped palm area for receiving the palm of the swimmer's hand. The paddle includes areas for receiving the thumb and fingers of the swimmer's hand. A wrist strap and one or more finger straps secures the user's hand to the paddle. The palm area, and also the areas which receive the swimmer's thumb and fingers, are provided with a series of apertures to allow the swimmer to feel passing water. The paddle is shaped to include an inwardly directed groove such that the peripheral portion of the paddle nearest the swimmer's second finger lies closer to the central palm area than do the peripheral portions nearest the index finger and ring finger. Also, an indented peripheral portion is formed between the swimmer's thumb and index finger.

1 Claim, 4 Drawing Sheets

SWIMMER TRAINING PADDLE SIMULATING SHAPE OF HUMAN HAND

BACKGROUND OF THE INVENTION

1. Field of the Invention

This invention relates generally to training aids for swimmers and, more particularly, to training paddles used to increase the water's resistance to a swimmer's hand strokes for strengthening a swimmer's arms and shoulders.

2. Description of the Related Art

A swimmer is propelled forward through the water by, in part, pulling the water with his or her hands. As is true in most forms of exercise, the amount of effort a participant must exert depends upon the amount of resistance to be overcome; the greater the resistance, the greater the force that must be applied, and the stronger the participant's muscles become.

One well-known method of increasing the resistance to a swimmer's hand strokes is the use of hand paddles worn on a swimmer's hands. Hand paddles have long been used to increase stroke strength and to enhance endurance. For example, U.S. Pat. No. 183,045 to Dunlop, issued in 1876, discloses a generally elliptical swimming paddle, or "hand-plate" formed of wood; a user places his or her palm against the top surface of the plate, and a strap extends about the top of the user's hand to secure the paddle against the user's palm.

Other forms of swimming paddles are known in the art, such as the generally rectangular-shaped paddles disclosed in U.S. Pat. No. 1,621,693 to Theobold, and U.S. Pat. No. 3,765,042 to Montrella. While most of such paddles are unitary and rigid, other swimming paddles include hinged members, as disclosed in U.S. Pat. No. 2,017,463 to Komadina. In most instances, straps, rubber tubes, or belts are used to secure the paddle to the user's hand; in other instances, the paddle includes slots through which the user inserts his or her hands and fingers, as disclosed in U.S. Pat. No. 2,109,429 to Malm. Such swimming paddles may be generally solid, as disclosed for example in U.S. Pat. No. 2,555,969 to Holcombe, or include apertures and/or perforations, as disclosed in U.S. Pat. No. 4,913,418 to Schlueter and Johnson, and in Applicant's U.S. Pat. No. 5,511,998, for selectively reducing resistance to the passage of water at selected locations, and/or to provide the user with a "feel for the water".

In designing a swimming paddle, one must be careful to apply increased resistance to the swimmer's arms and shoulders in a manner that avoids injury. Competitive swimmers commonly suffer shoulder injuries, particularly, problems with the rotator cuff, and swimming paddles that increase resistance to a swimmers's hand stroke can also potentially increase the risk of injury to the swimmer's shoulder if not used in a progressive built-up manner.

When a swimmer is swimming normally without the use of paddles, the swimmer's forwardly-extended hand and fingers "catch" the water as the swimmer's hand first enters the water. Training paddles have been produced in a variety of sizes, some being barely larger than the user's hand, and others being significantly larger than the user's hand to increase training resistance. One difficulty which typically arises with the use of larger-sized paddles is that it is more difficult for the user to "catch" the water at the beginning of each stroke. Instead of the top end of the paddle digging into, and catching, the surface of the water (the way that the cupped fingers of a user's hand would do), the top end of the paddle tends to plane forward along the surface of the water, creating an unnatural motion in the user's stroke.

Moreover, most training paddles are generally flat, while a swimmer's palm would normally assume a cupped shape as the swimmer starts each hand stroke. Accordingly, known paddles generally fail to conform to the user's palm in use, creating an unnatural feel for the user.

In addition, many of the known varieties of swimming paddles may work in a satisfactory manner for some types of swimming strokes, but not for others. For example, many known paddles perform reasonably well for freestyle and breaststroke, but are awkward for use during backstroke and/or butterfly training.

Accordingly, it is an object of the present invention to provide an improved swimming paddle that increases a swimmer's arm strength and endurance without placing excessive resistance on the rotator cuff joint within the user's shoulder as might cause injury to the user's shoulder.

It is another object of the present invention to provide such a swimming paddle that allows the user to achieve a better "feel" for the water, and which more closely simulates the swimmer's feel for the water during those times when no swimming paddle is used, instead of desensitizing the palm and fingers to the subtle changes in water pressure encountered during the stroke.

Still another object of the present invention is to provide such a swimming paddle which more closely conforms to the shape of the user's palm as when swimming without a training paddle, thereby heightening the user's feel for the water during each stroke.

A further object of the present invention is to provide such a swimming paddle that more securely positions the paddle upon the user's hand, thereby maintaining the paddle in its most effective and balanced position upon the user's hand.

A yet further object of the present invention is to provide such a swimming paddle which allows a user to better "catch" the water at the start of each stroke, rather than planing forward as the tip of the paddle enters the water.

These and other objects of the present invention will become more apparent to those skilled in the art as the description of the present invention proceeds.

SUMMARY OF THE INVENTION

Briefly described, and in accordance with the preferred embodiment thereof, the present invention is a swimming paddle for use on the hand of a swimmer, the swimming paddle including a generally planar member. One aspect of the present invention relates to a swimming paddle that includes a raised, dome-shaped palm area for receiving the cupped palm of the swimmer's hand. The swimming paddle also includes a thumb area for receiving the swimmer's thumb, an index finger area for receiving the swimmer's index finger, a second finger area for receiving the swimmer's second finger, and a ring finger area for receiving the swimmer's ring finger, all generally lying within a common plane. A hand strap, which ideally extends across the swimmer's wrist, helps secure the paddle to the swimmer's hand. To further stabilize the paddle on the swimmer's hand, the paddle may also be provided with one or more finger straps for engaging, for example, the second finger and/or ring finger of the swimmer. Preferably, the dome-shaped palm area has at least one aperture formed therein to expose the palm of the swimmer's hand to water. Ideally, the thumb area, index finger area, second finger area, and ring finger area each include apertures formed therealong for exposing the swimmer's thumb and fingers to the water. The paddle is preferably made of is made of polyvinyl chloride (PVC) foam.

Another aspect of the present invention relates to a swimming paddle having a shape along its periphery which more closely simulates the shape of the human hand. In this regard, the swimming paddle includes a generally planar member having an outer periphery and having a central palm area for receiving the swimmer's palm, a thumb area for receiving the swimmer's thumb, an index finger area for receiving the swimmer's index finger, a second finger area for receiving the swimmer's second finger, and a ring finger area for receiving the swimmer's ring finger. The outer periphery of the generally planar member includes a thumb tip peripheral portion, an index finger tip peripheral portion, a second finger tip peripheral portion, and a ring finger tip peripheral portion. Preferably, the second finger tip peripheral portion lies closer to the central palm area than is true for either the index finger tip peripheral portion or the ring finger tip peripheral portion. Thus, the second finger tip peripheral portion forming an inwardly-directed groove or trough that extends toward the swimmer's second finger. Ideally, an indented peripheral portion is also formed between the thumb tip peripheral portion and the index finger tip peripheral portion, wherein this indented peripheral portion lies closer to the central palm area than either the thumb tip peripheral portion or the index finger tip peripheral portion. This indented peripheral portion forms an inwardly-directed groove extending between the swimmer's thumb and index finger. The palm area of this paddle may be dome-shaped if desired, and the palm, thumb and finger areas preferably include apertures to increase the swimmer's feel of the water. The paddle may be secured to the swimmer's hand in the general manner described above.

Another aspect of the present invention relates to the placement of the apertures in a swimming paddle to enhance the swimmer's feel for the water while wearing the paddle. In this regard, the swimming paddle includes a generally planar member having an outer periphery and having a palm area for receiving the swimmer's palm, a thumb area for receiving the swimmer's thumb, an index finger area for receiving the swimmer's index finger, a second finger area for receiving the swimmer's second finger, a ring finger area for receiving the swimmer's ring finger, and a little finger area for receiving the swimmer's little finger. The palm area has apertures (preferably oval-shaped) formed therein to expose the palm of the swimmer's hand to the water. Similarly, the thumb area includes apertures (preferably oval-shaped) extending generally between the palm area and the thumb tip peripheral portion for exposing the swimmer's thumb to the water. Likewise, each of the index finger area, second finger area, ring finger area, and little finger area include apertures (preferably oval-shaped) extending generally between the palm area and the respective finger tip peripheral portion for exposing each such finger to the water. Again, the palm area of this paddle may be dome-shaped, if desired, and the paddle may be secured to the swimmer's hand in the general manner described above.

DETAILED DESCRIPTION OF THE PREFERRED EMBODIMENT

Figure 1:
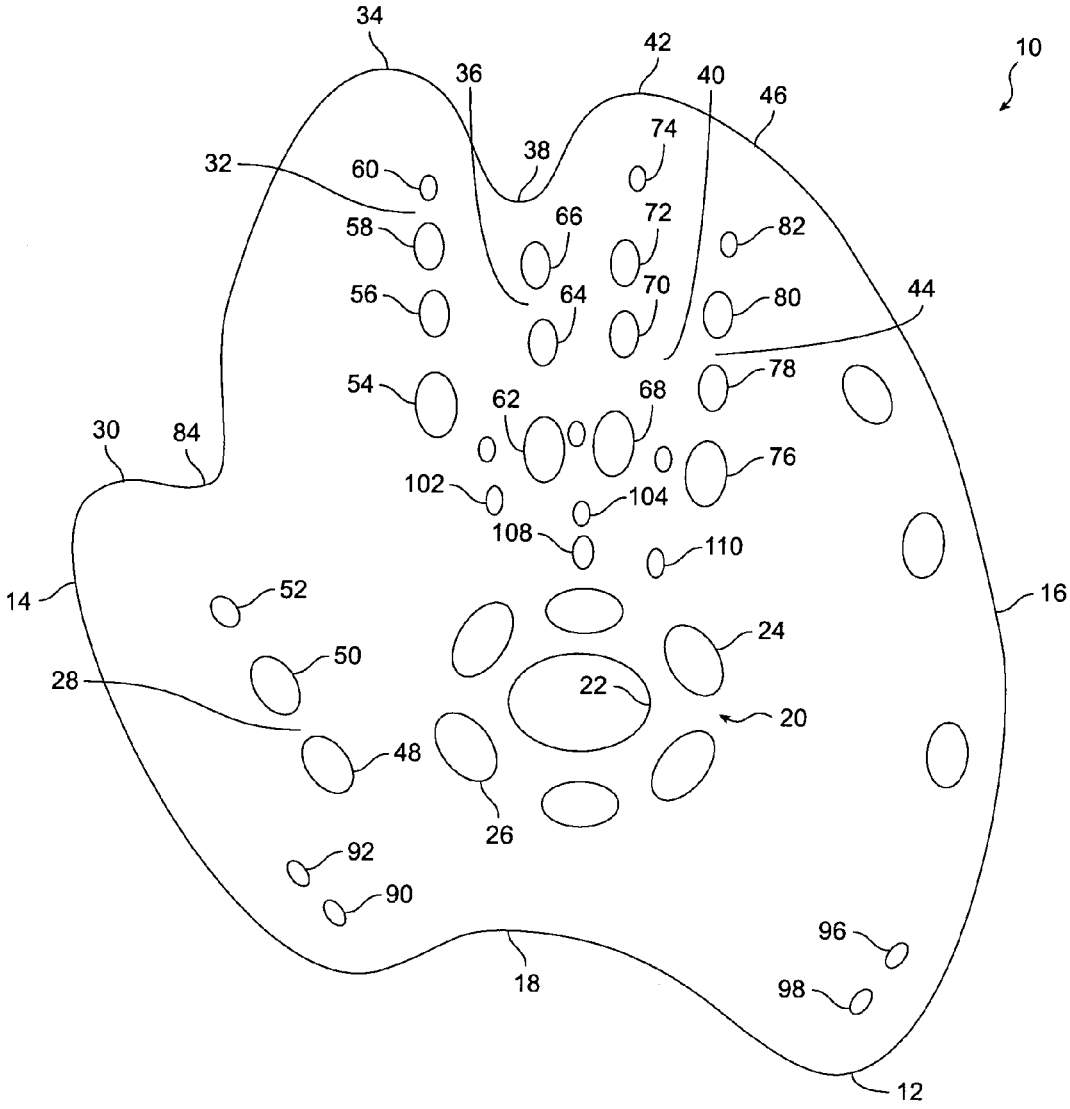
FIG. 1 is a plan view of a swimming paddle for a swimmer's right hand, prior to attachment of elastic attachment bands, in accordance with the preferred embodiment of the present invention.
Figure 2:
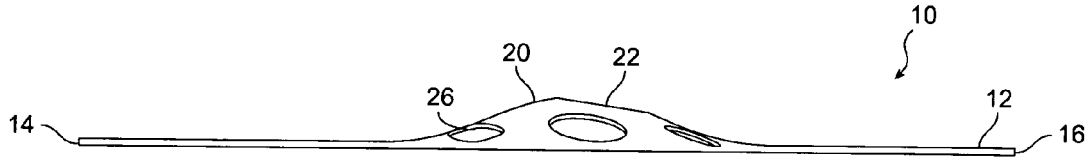
FIG. 2 is a side view of the swimming paddle shown in FIG. 1 and illustrating a raised dome portion for engaging the cupped palm of the swimmer.
Figure 3:
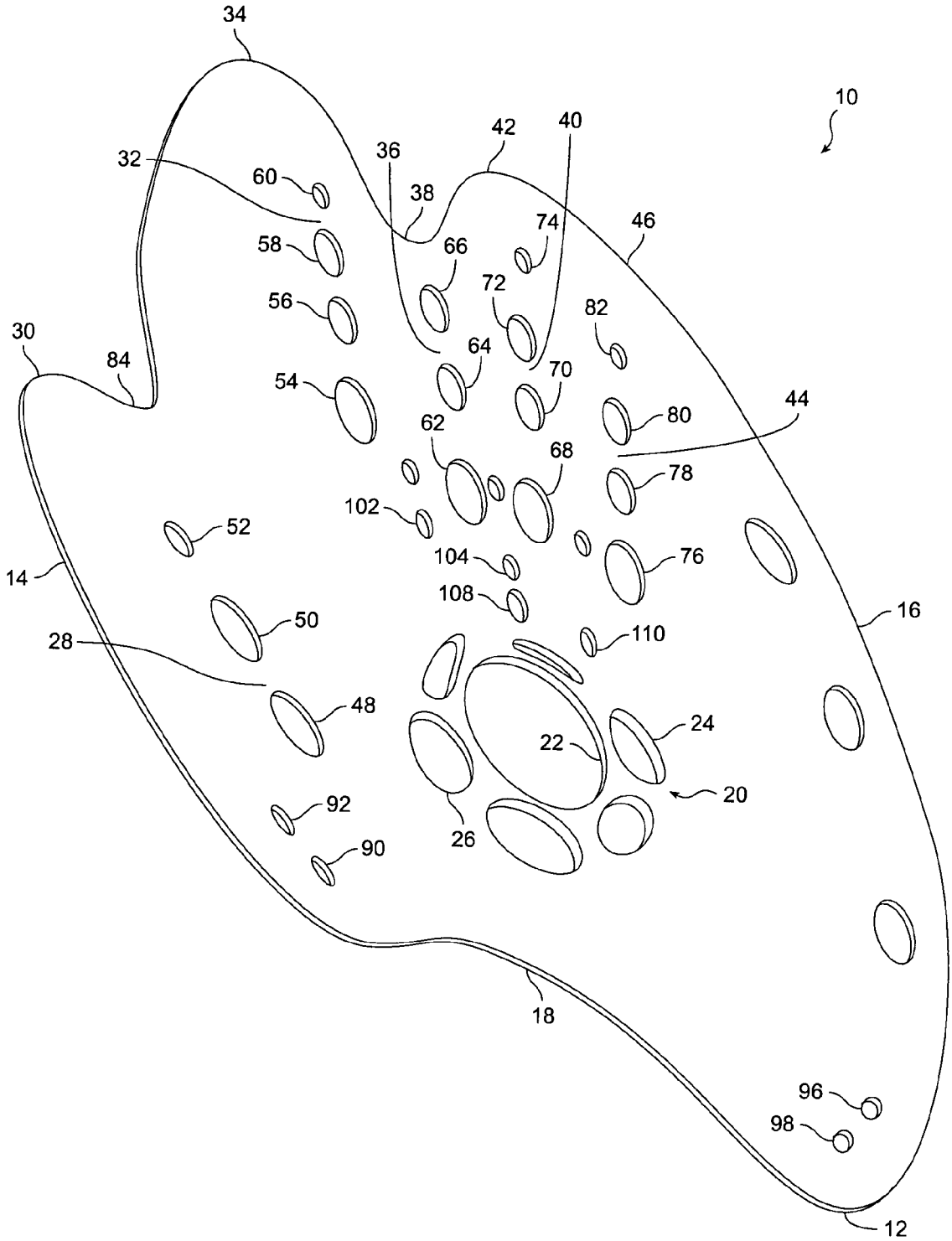
FIG. 3 is a perspective view of the swimming paddle shown in FIGS. 1 and 2.

FIGS. 1–3 illustrate a swimming paddle 10 constructed in accordance with the preferred embodiment of the present invention. Swimming paddle 10 is designed to be worn on the right hand of the swimmer. Those skilled in the art will realize that such swimming paddles are typically sold in pairs, and that the swimming paddle for the swimmer's left hand will be a mirror image of swimming paddle 10.

Swimming paddle 10 is formed from a generally planar member 12. In the preferred embodiment, member 12 is formed of polyvinyl chloride (PVC) foam which may be either injection-molded or deformed thermally from PVC foam sheet material. Member 12 is preferably approximately 1/16 to 3/16 inch thick, depending upon the material used. This thickness provides sufficient resiliency to enhance the swimmer's feel for the water, while being sufficiently rigid to avoid collapse under typical training conditions. Member 12 includes a first side peripheral edge 14 and an opposing second side peripheral edge 16. Member 12 also includes a peripheral wrist edge 18 which receives the underside of the swimmer's wrist.

As shown in FIGS. 1–3, swimming paddle 10 includes a raised central dome-shaped area 20 which raises above the plane that contains the remainder of generally planar member 12. This dome-shaped area 20 is designed to receive, and extend within, the cupped-palm of the swimmer's hand. Dome-shaped area 20 is therefore referred to herein as the palm area of swimming paddle 10. Palm area 20 includes a central aperture 22 and a series of surrounding apertures, including those designated 24 and 26, which allow water to contact the swimmer's palm and thereby provide a better "feel" for the water while paddle 10 is being worn. These apertures are preferably oval-shaped to increase the exposed surface area of the palm to the water. The shape of palm area 20 also provides a more natural feel to the swimmer, since a swimmer's hand is normally anatomically maintained in a semi-cupped shape during the course of each stroke, and palm area 20 conforms to, and extends within, the swimmer's palm. In the preferred embodiment, the dome of palm area 20 crests about a half-inch above the upper surface of the remaining portions of generally planar member 12. It has also been found that the raised dome shape of palm area 20 allows swimming paddle 10 to be mounted to the swimmer's hand more securely, with less chance of twisting, shifting or slipping.

Swimming paddle 10 also includes a thumb area 28 extending proximate first side edge 14 for receiving the swimmer's thumb. Thumb area 28 extends generally between peripheral wrist edge 18 and a thumb tip peripheral portion 30 toward which the swimmer's thumb is directed. Swimming paddle 10 also includes an index finger area 32 for receiving an index finger of the swimmer's hand; index finger area 32 generally extends between palm area 20 and an index finger tip peripheral portion 34 toward which the swimmer's index finger is directed. Paddle 10 also includes a second finger area 36 for receiving the swimmer's second finger; second finger area 36 generally extends between palm area 20 and a second finger tip peripheral portion 38 toward which the swimmer's second finger is directed. Likewise, paddle 10 includes a ring finger area 40 for receiving the swimmer's ring finger; ring finger area 40 generally extends between palm area 20 and ring finger tip peripheral portion 42 toward which the swimmer's ring finger is directed. Finally, paddle 10 further includes a little finger area 44 for receiving the swimmer's little finger; little finger area 44 generally extends between palm area 20 and little finger tip peripheral portion 46 toward which the little finger of the swimmer's hand is directed.

To provide enhanced "feel" for the water, thumb area 28, index finger area 32, second finger area 36, ring finger area 40, and little finger area 44 each include a series of apertures (preferably oval-shaped) formed therealong for exposing the swimmer's thumb and fingers to the water. In this regard, thumb area 28 includes apertures 48, 50, and 52 which extend in a pattern to follow the swimmer's thumb. Likewise, index finger area 32 includes apertures 54, 56, 58 and 60 which serve to expose significant portions of the swimmer's index finger to the water. Similarly, second finger area 36 includes apertures 62, 64, and 66; ring finger area includes apertures 68, 70, 72 and 74; and little finger area 44 includes apertures 76, 78, 80 and 82. Apertures 83, 85, and 87 are also formed along side 16 of planar member 12 to release some of the water pressure which is the area that has been identified as causing most shoulder irritation in the use of over-sized paddles.

Still referring to FIGS. 1 and 3, those skilled in the art will note that the outer periphery of swimming paddle 10, particularly in the region adjacent index finger tip peripheral portion 34, second finger tip peripheral portion 38, and ring finger tip peripheral portion 42, differs from known swimming paddles. While known paddles typically have a straight or rounded periphery in such region, swimming paddle 10 is shaped such that second finger tip peripheral portion 38 lies significantly closer to palm area 20 than is true for index finger tip peripheral portion 34 and ring finger tip peripheral portion 42. In this manner, second finger tip peripheral portion 38 forms an inwardly-directed groove, or trough, extending toward the tip of the swimmer's second finger. This feature allows swimming paddle 10 to more effectively "catch" the water as the swimmer starts each stroke.

Furthermore, it will also be noted that the outer periphery of generally planar member 12 includes an indented peripheral portion 84 which lies between thumb tip peripheral portion 30 and index finger tip peripheral portion 34. This indented peripheral portion 84 extends closer to palm area 20 than either thumb tip peripheral portion 30 or index finger tip peripheral portion 34. Thus, indented peripheral portion 84 forms an inwardly-directed groove extending between the swimmer's thumb and index finger. Indented peripheral portion 84 again allows swimming paddle 10 to more effectively "catch" the water as the swimmer starts each stroke. The trough formed proximate second finger tip peripheral portion 38, and indented peripheral portion 84, result in a swimming paddle that more closely simulates the human hand, and allows the tip of the second finger to be directly exposed to the flow of the water allowing it to be even more sensitive.

Figure 4:
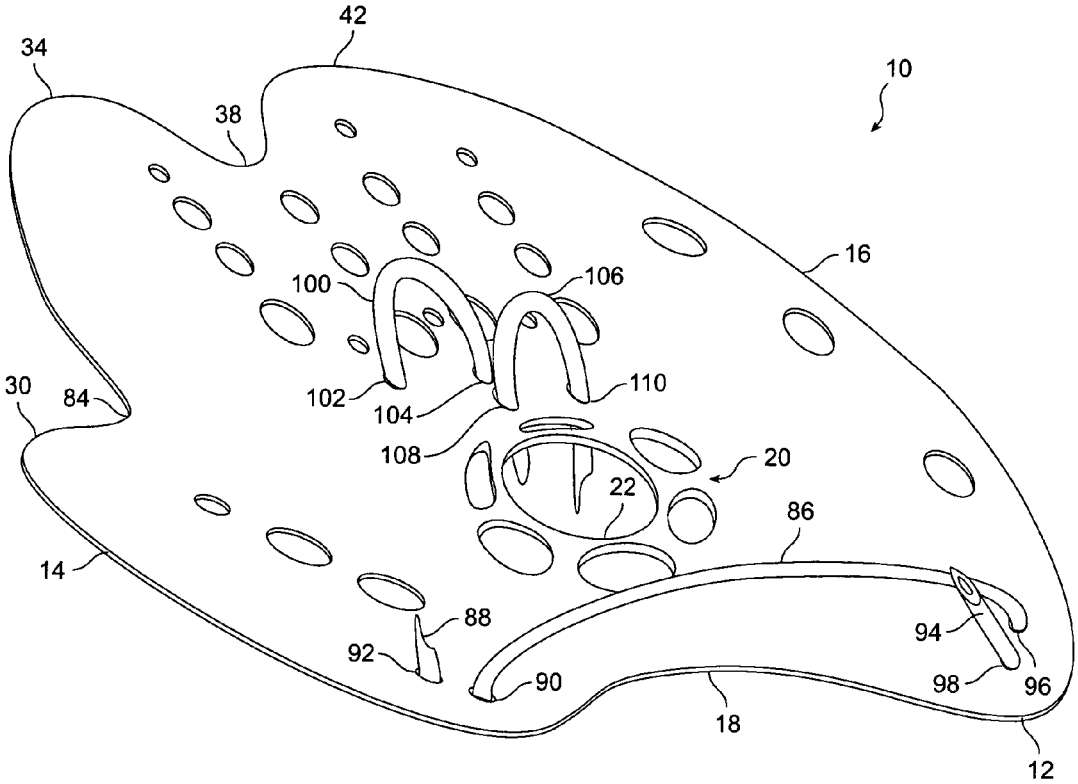
FIG. 4 is a perspective view of the swimming paddle shown in FIG. 1 following installation of three elastic tubing attachment bands for securing the paddle to the swimmer's wrist and fingers.
Figure 5:
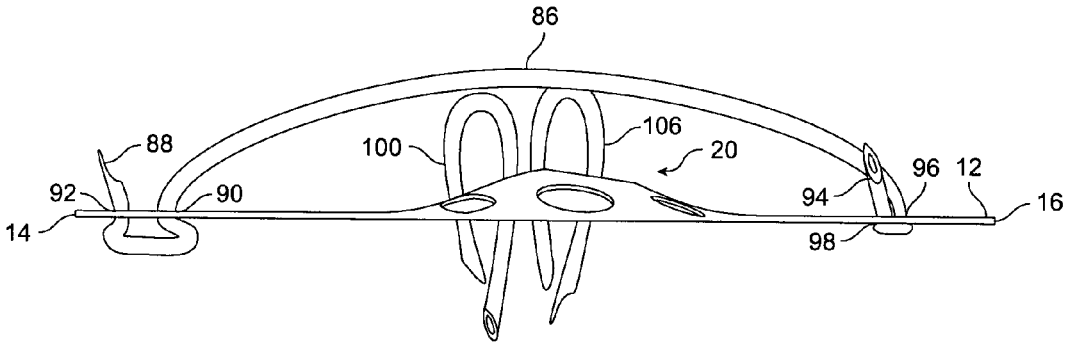
FIG. 5 is a side view of the swimming paddle shown in FIG. 4.

Turning to FIGS. 4 and 5, a series of attachment bands are illustrated for removably securing swimming paddle 10 to a swimmer's hand. A wrist strap 86 is formed of elastic rubber tubing for extending over the top of the swimmer's hand/wrist for securing the underside of the swimmer's hand and wrist against swimming paddle 10. A first end 88 of wrist strap 86 is laced through mounting holes 90 and 92 adjacent first side edge 14 of member 12, and second end 94 of wrist strap 86 is laced through mounting holes 96 and 98 adjacent second side edge 16 of member 12. Preferably, mounting holes 90, 92, 96 and 98 are formed proximate peripheral wrist edge 18.

To further stabilize swimming paddle 10 against the underside of the swimmer's hand, a finger strap 100, formed from a shorter length of elastic rubber tubing, is provided to extend about the swimmer's second finger, preferably near the base of the second finger. The opposing ends of finger strap 100 extend through mounting holes 102 and 104, respectively, disposed on opposite sides of second finger area 36. Preferably, another finger strap 106, also formed from a short length of elastic rubber tubing, is provided to extend about the swimmer's ring finger, again preferably near the base of the ring finger. The opposing ends of finger strap 106 extend through mounting holes 108 and 110, respectively, disposed on opposite sides of ring finger area 40.

Figure 6:
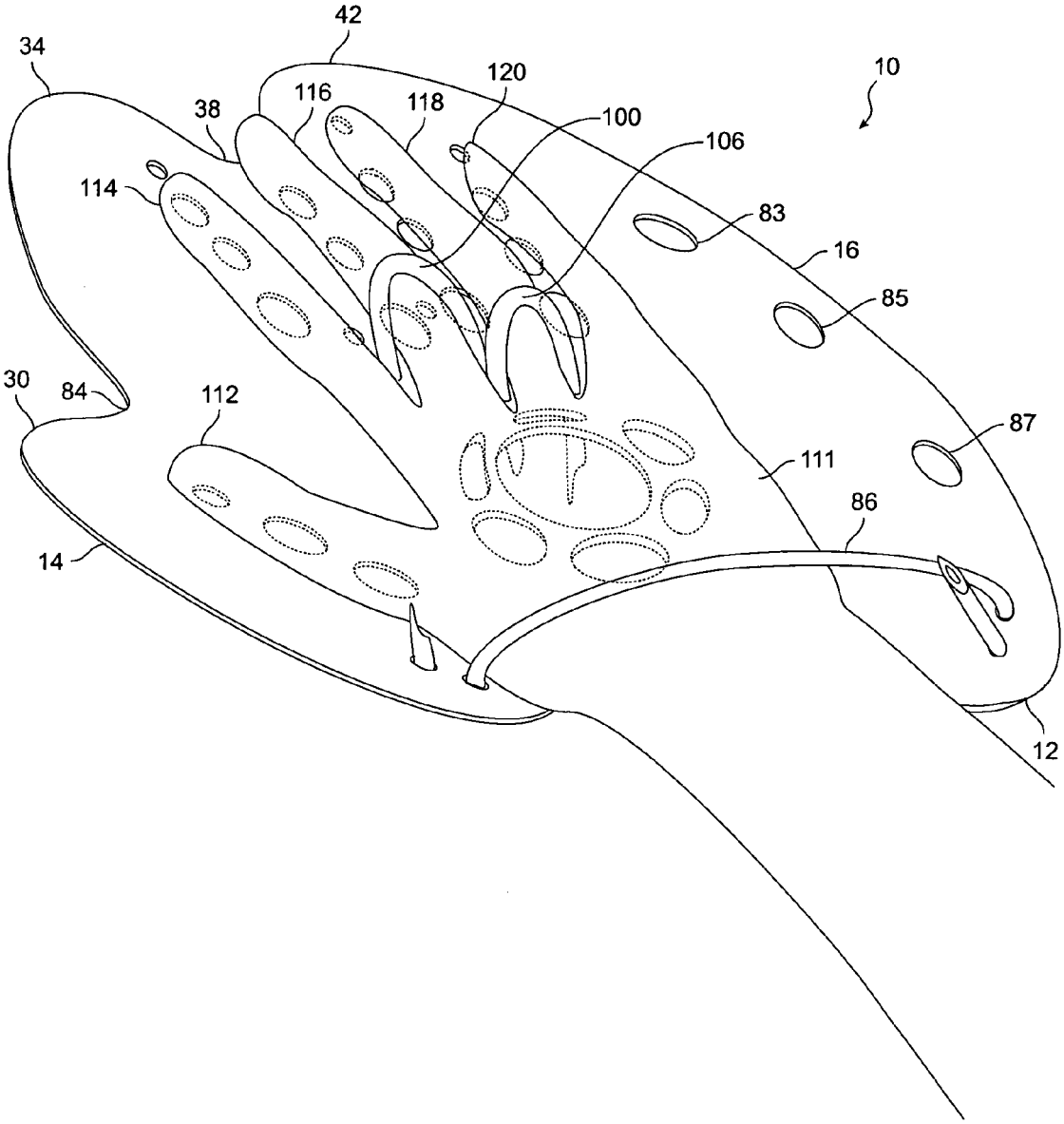
FIG. 6 is a perspective view of the swimming paddle shown in FIGS. 4 and 5 being worn on a swimmer's hand.

FIG. 6 shows swimming paddle 10 mounted upon the hand 111 of a swimmer for use. The swimmer's thumb 112 lies over thumb area 28; the swimmer's index finger 114 lies over index finger area 32; second finger 116 overlies second finger area 36; ring finger 118 lies over ring finger area 40; and the swimmer's little finger 120 overlies little finger area 44. Wrist strap 86 extends over and around the swimmer's hand 111, and finger straps 100 and 106 extend around and over the swimmer's second finger 116 and ring finger 118, respectively.

Those skilled in the art will now appreciate that an improved swimming paddle has been described for increasing a swimmer's arm strength and endurance while minimizing the risk of rotator cuff joint injury within the user's shoulder. The disclosed paddle allows the user to achieve a better "feel" for the water, and more realistically simulates the swimmer's feel for the water during those times when no swimming paddle is used. The raised dome palm area more closely conforms to the shape of the user's palm as when swimming without a training paddle, and makes the use of such swimming paddle feel more natural. The raised dome palm area also aids in securely positioning the paddle upon the swimmer's hand to maintain the paddle in its most effective position. In addition, the contour of the outer periphery of the disclosed paddle allows a user to better "catch" the water at the start of each stroke. It will be appreciated that the disclosed swimming paddle may be produced in a range of sizes (small, medium, large, etc.) to accommodate varying hand sizes.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

I claim:

1. A swimming paddle for use on the hand of a swimmer within a body of water, said swimming paddle comprising:

a. a generally planar member having an outer periphery and having opposing first and second sides, a palm area for receiving a palm of the swimmer's hand, a thumb area extending proximate the first side of said generally planar member for receiving a thumb of the swimmer's hand, an index finger area for receiving an index finger of the swimmer's hand, a second finger area for receiving a second finger of the swimmer's hand, a ring finger area for receiving a ring finger of the swimmer's hand, and a little finger area for receiving a little finger of the swimmer's hand; and b. the outer periphery of said generally planar member including:

i. a thumb tip peripheral portion toward which the swimmer's thumb extends;

ii. an index finger tip peripheral portion toward which the swimmer's index finger extends;

iii. a second finger tip peripheral portion toward which the swimmer's second finger extends;

iv. a ring finger tip peripheral portion toward which the swimmer's ring finger extends; and v. a little finger tip peripheral portion toward which the swimmer's little finger extends;

c. said palm area including a plurality of palm apertures formed therein to directly expose the palm of the swimmer's hand to water via said palm apertures;

d. said thumb area including a plurality of thumb apertures extending generally between said palm area and said thumb tip peripheral portion for directly exposing the swimmer's thumb to water via said thumb apertures;

e. said index finger area including a plurality of index finger apertures extending generally between said palm area and said index finger tip peripheral portion for directly exposing the swimmer's index finger to water via said index finger apertures;

f. said second finger area including a plurality of second finger apertures extending generally between said palm area and said second finger tip peripheral portion for directly exposing the swimmer's second finger to water via said second finger apertures;

g. said ring finger area including a plurality of ring finger apertures extending generally between said palm area and said ring finger tip peripheral portion for directly exposing the swimmer's ring finger to water via said ring finger apertures;

h. said little finger area including a plurality of little finger apertures extending generally between said palm area and said little finger tip peripheral portion for directly exposing the swimmer's little finger to water via said little finger apertures; and i. a first strap having first and second opposing ends for securing said generally planar member to the swimmer's hand, the first end of said first strap being secured to said generally planar member proximate the first side thereof, and the second end of the first strap being secured to said generally planar member proximate the second side thereof, the first strap being adapted to extend over the top of the swimmer's hand;

j. wherein said thumb apertures, index finger apertures, second finger apertures, ring finger apertures, and little finger apertures each decrease in size as said thumb apertures, index finger apertures, second finger apertures, ring finger apertures, and little finger apertures are distanced further from said palm area.

* * * * *